United States Patent [19]

Geraci

[11] Patent Number: 4,632,385

[45] Date of Patent: Dec. 30, 1986

[54] WALKING EXERCISE APPARATUS

[76] Inventor: Alexander Geraçi, 5221 North Lind Ave., Chicago, Ill. 60630

[21] Appl. No.: 776,138

[22] Filed: Sep. 13, 1985

[51] Int. Cl.[4] ..... A63B 23/04

[52] U.S. Cl. ..... 272/70; 272/97; 272/69

[58] Field of Search ..... 272/69, 70, 97, 134, 272/126, 127, 116, 145, 93, 96, 72, 132, DIG. 9; 128/25 R, 25 B

[56] References Cited

U.S. PATENT DOCUMENTS

| | | | |
|---|---|---|---|
| 430,808 | 6/1890 | Naish | 272/70 |
| 1,982,843 | 12/1934 | Traver | 272/72 |
| 2,772,881 | 12/1956 | Fundom | 272/70 |
| 2,969,060 | 1/1961 | Swanda et al. | 128/25 R |
| 4,402,506 | 9/1983 | Jones | 272/70 X |
| 4,413,821 | 11/1983 | Centafanti | 272/69 |
| 4,434,981 | 3/1984 | Norton | 272/97 |
| 4,445,683 | 5/1984 | Ogden | 272/69 |
| 4,512,571 | 4/1985 | Hermelin | 272/126 |
| 4,529,194 | 7/1985 | Haaheim | 272/69 |

FOREIGN PATENT DOCUMENTS

| | | | |
|---|---|---|---|
| 2631897 | 1/1978 | Fed. Rep. of Germany | 272/97 |
| 220365 | 7/1959 | Netherlands | 272/134 |

*Primary Examiner*—Richard J. Apley
*Assistant Examiner*—John Welsh
*Attorney, Agent, or Firm*—Samuel Kurlandsky

[57] ABSTRACT

An exercise apparatus comprising a supporting frame formed of a pair of longitudinal spaced-apart and interconnected foot platform support and guide members and a pair of spaced-apart transverse frame members affixed thereto, a pair of spaced foot-supporting platforms mounted for guided parallel reciprocal movement, the foot support platforms being interconnected for relative movement only in opposite reciprocal directions, a pair of lateral supporting frames affixed to the frame, and a pair of arm support members pivotally mounted on the supporting frames with each arm support member having its lower end pivotally connected with a foot supporting platform, whereby the arm support members move reciprocally simultaneously with the foot supporting platforms, but in the opposite reciprocal direction.

7 Claims, 4 Drawing Figures

WALKING EXERCISE APPARATUS

BACKGROUND OF THE INVENTION

The present invention relates generally to body exercising apparatus and more particularly to a walking exerciser.

A great many walking-type exercise apparatus have been devised utilizing reciprocally moveable foot supports which allows an individual to move his legs in a manner similar to walking or skiing, as in U.S. Pat. Nos. 4,402,506 and 4,454,981. In U.S. Pat. No. 2,969,060 motor driven reciprocally moveable foot supports and arm support means are provided especially for individuals not capable of normal walking.

BRIEF SUMMARY OF THE INVENTION

The exercise apparatus of the present invention comprises a supporting frame having a pair of spaced foot supporting platforms mounted for guided parallel reciprocal movement with the foot support platforms interconnected for relative movement only in opposite reciprocal directions and having a pair of upwardly extending lever-like arm support members pivotly mounted at about the mid-point thereof on the supporting frame with each arm support member having the lower end thereof pivotly connected with a foot supporting platform so that the arm support member moves reciprocally simultaneously with the foot supporting platform but in the opposite reciprocal direction. The present invention, thus, provides an improved walking exercise apparatus which is simple in construction and at the same time provides an individual with complete control over the amount of effort which the legs and arms are required to expend, ranging from a slow walk or shuffle to a maximum effort limited only by the strength of the individual's legs and arms, without the use of friction inducing means, elastic restraints or extraneous energy sources of any kind.

BRIEF DESCRIPTION OF THE DRAWING

In the drawing of the preferred illustrated embodiment of the present invention.

DETAIL DESCRIPTION

Figure 1:
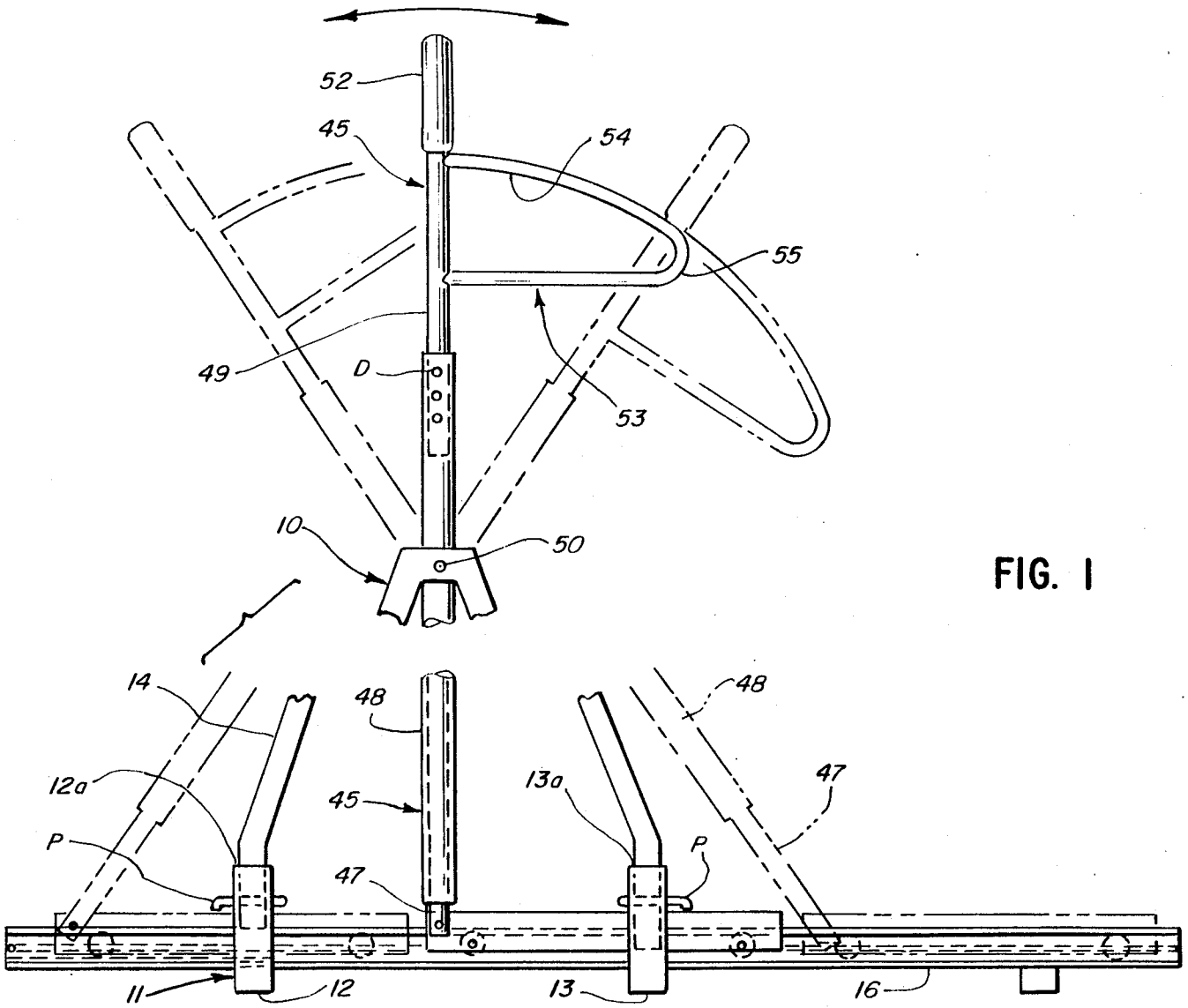
FIG. 1 is a side elevational view partially in section of the exercising apparatus.

The illustrated embodiment of the walking exercise apparatus 10 comprises a supporting frame or base section 11 which is formed of two spaced generally U-shaped transverse frame members 12, 13 and lateral frame members 14, 15 extending upwardly from the upstanding ends **12*a*, 12*b* and 13*a*, 13*b* of the U-shaped transverse frame members 12, 13. Two spaced interconnected platform support and guide members 16, 17 are fixedly connected to the spaced transverse frame members 12, 13. Each of the guide members 16, 17 has an identical open ended elongated rectangular structure with a planar upper and lower sections 18, 18'. Web elements 19, 19' and 20, 20' extending between the sections 18, 18' are spaced inwardly from each longitudinal edge of sections 18, 18'. Guide rail means 21, 21' and 22, 22' extend longitudinally along the outer lateral edge portions of the sections 18'. The upper surface of the guide rail means 21, 21' and 22, 22' are provided with parallel inverted V-shaped ridges 23, 23' and 24, 24' extending the length thereof for guiding the reciprocally moveable foot support platforms 25, 25'. The support and guide members 16, 17 which can be formed of extruded metal are connected by metal plates 28, 28' which are welded or bolted to the inner edge portions of the guide rail means 21', 22** at the upper and lower ends thereof.

The foot support platforms 25, 25' which are supported by the guide members 16, 17, respectively, are identical in construction and are formed with planar upper surfaces 30, 30' which are slightly wider than the planar surfaces 18 and preferably have short upperwardly extending flanges along each edge thereof to provide a recess in which is fitted a rubber mat M on which the foot is placed. Depending flanges 31, 31' and 32, 32' extend downwardly from the lateral longitudinal edges of the planar upper surfaces 30, 30', respectively. Wheel supporting axles 33, 33' and 34, 34' extend horizontally inwardly adjacent the front and rear ends of the flanges 31, 31' and 32, 32'. Grooved wheels 35, 35' and 36, 36' are mounted on the axles 33, 33' and 34, 34', respectively, so that the platforms 25, 25' are supported slightly elevated above the upper surface 18 of each of the guides 16, 17. The grooved wheels 35, 35' and 36, 36' are adapted to conform with the inverted V-shaped ridges 23, 23' and 24, 24' of the guide rail means 21, 22.

Figure 2:
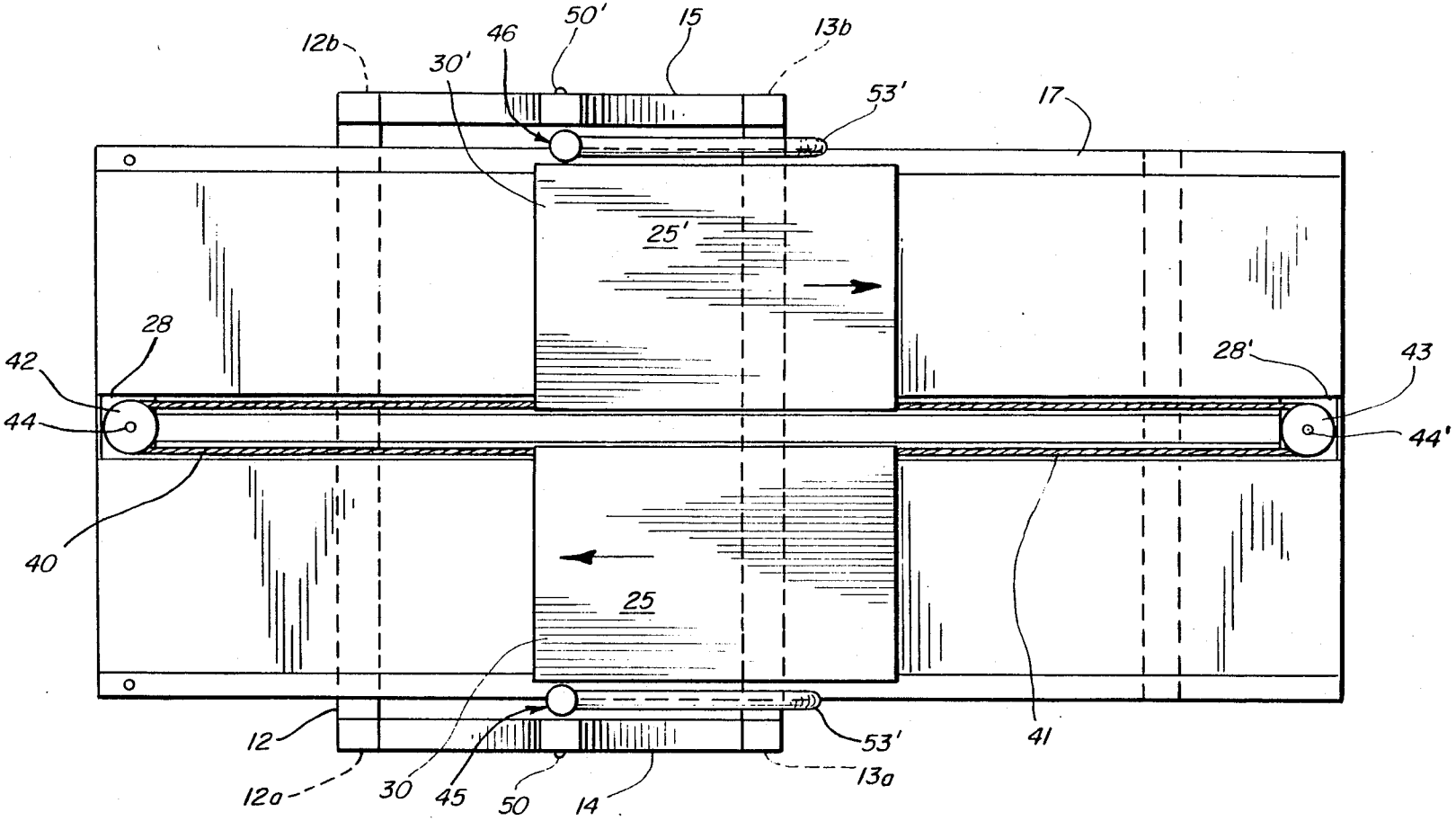
FIG. 2 is a plan view of FIG. 1.
Figure 3:
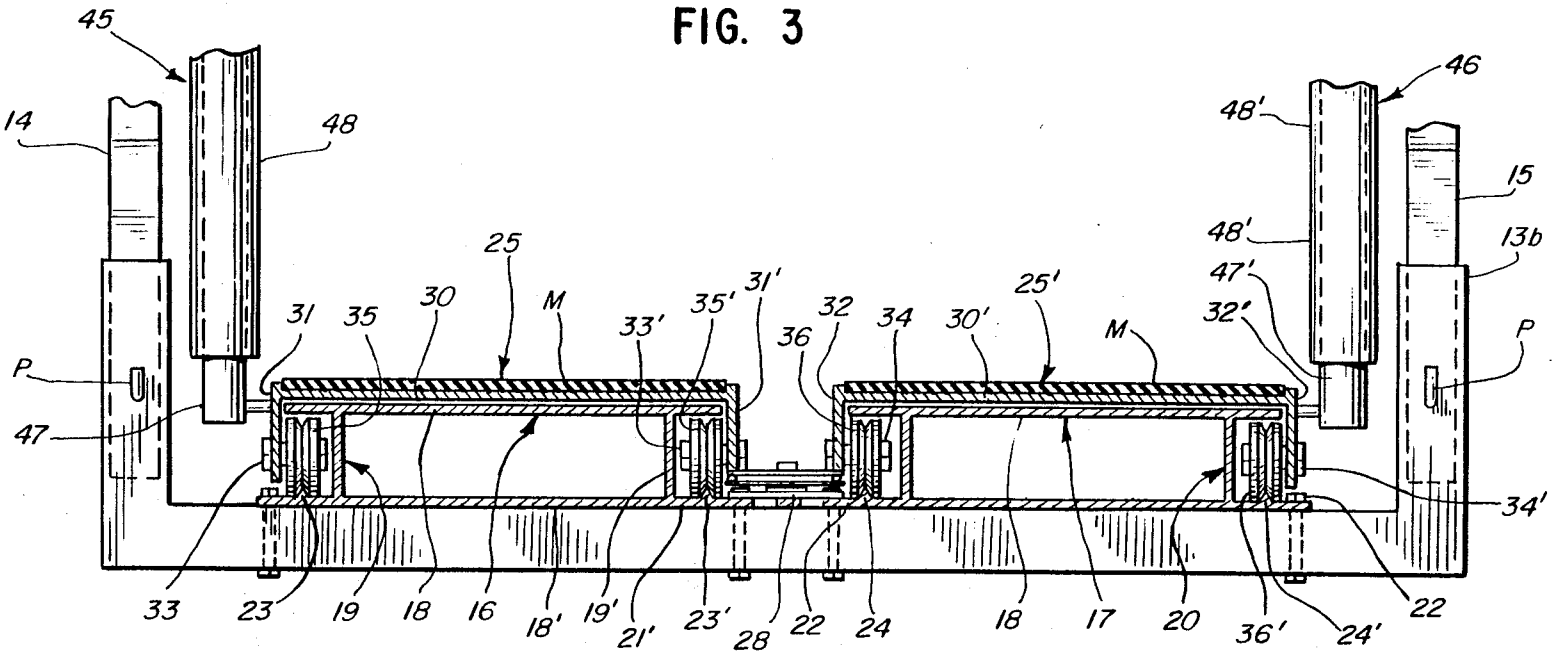
FIG. 3 is a vertical sectional view partially in elevation taken along the line 3—3 of FIG. 2.
Figure 4:
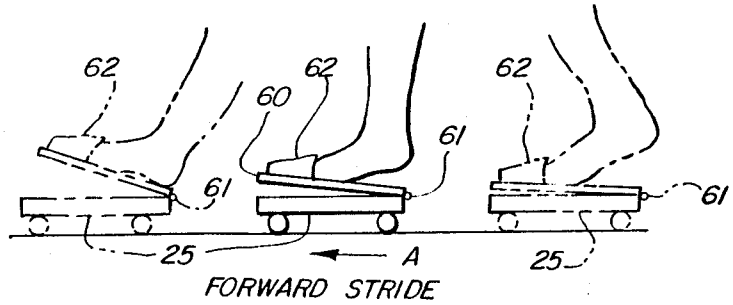
FIG. 4 is a schematic view of a modified form of the apparatus of FIG. 1.

The foot support platforms 25, 25' are interconnected by cables 40, 41 which ride on the horizontal disposed pulley wheels 42, 43, respectively, which are rotatably mounted on plates 28, 28'. As best shown in FIGS. 1 and 2, each of the pulley wheels 42, 43 rotates freely on the pivot pins 44, 44', respectively, which extend upwardly through the plates 28, 28'. The ends of the cable 40 are connected to the inner rear edge of the foot support platforms 25, 25', and the ends of the cable 41 are connected to the forward inner edge of the platforms 25, 25' so that the platforms 25, 25' are interconnected and can move only in opposite reciprocal directions.

The upwardly extending lateral frame members 14, 15 which are preferably detachably mounted in the upstanding ends **12*a*, 12*b*, and 13*a*, 13*b* of the transverse frame members 12, 13 have a generally A-frame configuration. Lever-like arm support means 45, 46 are pivotly mounted at about the mid-point thereof on fulcrums 50, 50', respectively, at the upper end of the lateral frame members 14, 15, respectively. The lower end of each of the lever arm support means 45, 46, comprises a tubular section 47, 47' the lower end of which is pivotally secured to the front end of flanges 31, 32°, respectively. Tubular sections 47, 47' preferably fit telescopically within the lower ends of elongated tubular sections 48, 48', respectively, to facilitate separating the arm support means 45, 46 from the transverse frame members 12, 13. Removable pins P extend through the ends of lateral frame members 14, 15 and the upstanding ends of transverse frame members 12, 13** to hold the frame assembly together while the apparatus is being used and permitting rapid disassembly for storage.

The upper end of each tubular section 48, 48' is provided with a handle section 49, 49' which preferably forms a telescopic engagement with tubular sections 48, 48'. The height of the handle sections 49, 49' preferably can be adjusted by moving the lower ends of sections 49, 49' relative to the upper ends of the tubular section 48, 48′ with detent means D or another adjusting means provided for maintaining the handle sections in a preselected portion.

The upper ends of the handle sections 49, 49′ are preferably provided with axially extending hand grip section 52, 52′, respectively, useful when simulating skiing, and a curved generally horizontally extending lower hand grip member 53 extending in a direction parallel with the direction of travel of the platforms 25, 25′ and spaced inwardly from the axially extending hand grip sections 52, 52′. The upper horizontally extending portion 54 of the lower hand grip member 53, 53′ can be conveniently used for natural walking exercising while the trailing rounded end portion 55 can be most conveniently used while exercising in a sitting position.

As schematically illustrated in FIG. 7, the uppermost surface of each foot support platform 25, 25′ is preferably provided with a flat plate 60 pivotly mounted, as on a transverse hinge element, on the trailing edge 61 of each foot platform 25, 25′. The forward end of each foot plate 60 has secured thereto a foot retaining member 62, such as a flexible strap, which is secured to and extends transversely across th plate 60. As the individual's foot and the foot platform 25 are moved forwardly, the hinged plate 60 is pivoted upwardly by the natural movement of the foot which is retained by the member 62. When the individual's foot and foot platform 25 are moved rearwardly, the plate 60 is pivoted downwardly into contact with the uppermost surface of the foot platform 25.

A tape player is preferably mounted on the lateral frame and is used in combination with the walking exerciser to provide instructions for controlling the speed or tempo of the exercise being performed in keeping with professional exercising standards. The tape provides timed periods of exercise with music controlling the tempo for warm up exercises, a period of vigorous exercising and a cooling off period and can range from a few minutes to thirty minutes. An individual can select a tape program to fit his individual needs or have a program prescribed for him by his physician.

An individual who is unable to exercise from a standing position can use the walking exerciser of the present invention from a sitting position by using a bench (not shown) which can be attached directly to the supporting frame of the exerciser.

I claim:

1. An exercise apparatus comprising a supporting frame assembly with a base section and a pair upstanding lateral members disposed on opposite sides of said base section, a pair of spaced foot support platforms mounted for guided parallel reciprocal movement on said base section and interconnected for relative movement only in opposite reciprocal directions, upwardly extending arm support means pivotally mounted at about the mid-point thereof one on each of said upstanding lateral members of the supporting frame assembly, and each of said arm support means having the lower end thereof pivotally connected to one of said foot support platforms for simultaneous reciprocal movement of the upper ends thereof in a direction opposite to the movement of said foot support platform connected therewith.

2. An exercise apparatus as in claim 1, wherein said base section of the supporting frame assembly comprises two parallel interconnected spaced guide members which support and guide said foot support platforms, and a pair of substantially parallel spaced-apart U-shaped transverse members having upwardly extending ends, each transverse member affixed to and supporting said guide members, said lateral members extending upwardly from the upwardly extending ends of the spaced U-shaped transverse members, and each said arm support means being pivotally mounted at the upper end of each of said lateral members.

3. An exercise apparatus as in claim 2, wherein said lateral members and arm support means are detachably connected with said support frame assembly and foot supporting platforms.

4. An exercise platform as in claim 2, wherein said foot support platforms are each provided with axles on which wheels are rotatably mounted having radial grooves, and wherein said guide members are provided with parallel inverted V-shaped ridges positioned in said radial grooves for guiding said wheels.

5. An exercise apparatus as in claim 1, wherein each said arm support means has a curved hand grip member extending in a direction parallel with the direction of movement of said foot supporting platform.

6. An exercising apparatus as in claim 5, wherein said hand grip member comprises a curved member extending from said arm support means at space points adjacent the upper end thereof.

7. An exercise apparatus as in claim 1, wherein each of said foot support platforms has a trailing edge and has pivotally secured to the trailing edge thereof a plate member extending substantially the length of the platform and having a foot retaining means on said plate adjacent the forward end thereof.

* * * * *